US005354971A

United States Patent [19]

Chen

[11] Patent Number: 5,354,971

[45] Date of Patent: Oct. 11, 1994

[54] DUAL PUSH-PULL HEATING DEVICE OF INDUCTION COOKER HAVING MULTIPLE BURNERS

[76] Inventor: Su-Min Chen, No. 9, Yung Kuang Lane, Herming Village, Show Shui Hsiang, Chang Hwa Hsien, Taiwan

[21] Appl. No.: 913,320

[22] Filed: Jul. 15, 1992

[51] Int. Cl.[5] ..... H05B 6/04

[52] U.S. Cl. ..... 219/661; 219/662; 363/97; 363/133

[58] Field of Search ..... 219/10.77, 10.75, 10.79, 219/10.493, 661, 662, 660; 363/97, 98, 133, 134

[56] References Cited

U.S. PATENT DOCUMENTS 4,549,056 10/1985 Okatsuka et al. ..... 219/10.77
4,749,836 6/1988 Matsuo et al. ..... 219/10.77
4,820,891 4/1989 Tanaka et al. ..... 219/10.77
5,079,399 1/1992 Itoh et al. ..... 219/10.77

*Primary Examiner*—Bruce A. Reynolds
*Assistant Examiner*—Tu Hoang
*Attorney, Agent, or Firm*—Browdy and Neimark

[57] ABSTRACT

A dual push-pull heating device of induction cooker having multiple burners is provided with a microprocessor controlling a logic amplifying drive circuit outputting a high-frequency pulse signal, so as to drive alternately at least a power element or power transistor having two parallel electromagnetic induction coils arranged at an end thereof in such a manner that a common end of said induction coils is connected with a common connection point of a relay whose normal close point is connected with a non-common end of one of the induction coils and whose normal open point is connected with a non-common end of another one of the induction coils.

5 Claims, 1 Drawing Sheet

DUAL PUSH-PULL HEATING DEVICE OF INDUCTION COOKER HAVING MULTIPLE BURNERS

BACKGROUND OF THE INVENTION

The present invention relates to an induction heating apparatus, and more particularly to a dual push-pull heating device of an induction cooker having multiple burners.

The prior art induction heating apparatus is generally composed of single push-pull switching drive circuit. In other words, such prior art apparatus uses a transistor power element to generate a high-frequency switching action of ON/OFF so as to condition an induction coil to generate an alternating magnetic field, which induces the induction heating apparatus to bring about heat. The power transistor is an expensive commodity in view of the fact that it must be capable of bearing a high-voltage current and of meeting certain specific sets of requirements for a high-frequency switching action. In addition, the maximum output power of a single push-pull induction heater can not be substantially expanded beyond 1200 w (1.2 kw) which is currently available. Therefore, the application of such single push-pull induction heating device is confined to a low power heating device.

Furthermore, the prior art induction heater is provided with an induction heating coil which is controlled by a set of switching drive circuits. It is a well-known fact that a good kitchen is generally equipped with more than one induction cooker. A conventional method of providing a kitchen with multiple induction cookers is to combine several induction cookers on the same cooking frame. Such method is expensive and therefore prohibits the induction cooker from becoming a popular and ubiquitous household appliance.

SUMMARY OF THE INVENTION

It is, therefore, the primary objective of the present invention to provide an induction cooker with a dual push-pull circuit for increasing the magnitude of its output power.

It is another objective of the present invention to provide an induction cooker with a switching drive circuit intended to control multiple induction heating coils so as to reduce the cost of making the circuit.

In keeping with the principles of the present invention, the foregoing objectives of the present invention are accomplished by a dual push-pull heating device of an induction cooker having multiple burners, which comprises a microprocessor capable of sending out an output control signal to regulate a dual push-pull logic amplifying drive circuit, so as to cause the two power elements to communicate alternately ON/OFF. As a result, these two power elements communicate with each other, with their common end communicating tandemly with two electromagnetic induction coils whose common end is connected with a connection point of a relay having a normal open point and a normal close point which are respectively connected with another ends of the two electromagnetic induction coils. One of the two induction coils is capable of being activated by a short circuit of the two induction coils by means of the relay. In other words, the control of the action of the two electromagnetic induction coils is brought about by a set of dual push-pull switching drive circuit. Such control of the two electromagnetic induction coils can be selectively accomplished by means of a relay.

The structures, functions and features of the present invention will be better understood by studying the following detailed description of a preferred embodiment of the present invention in conjunction with the drawings provided herewith.

DETAILED DESCRIPTION OF THE PREFERRED EMBODIMENT

Figure 1:
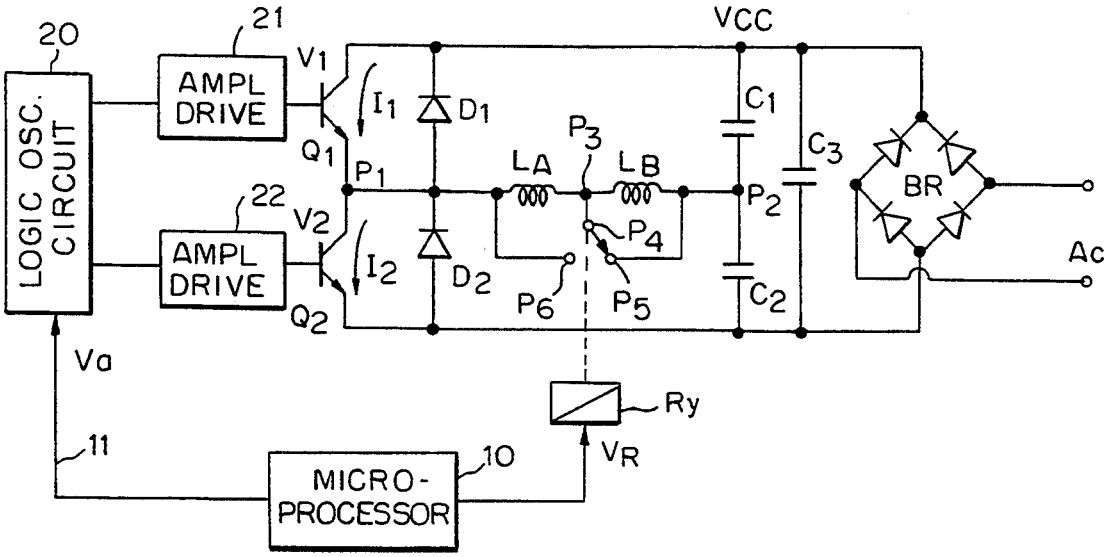
FIG. 1 shows a voltage circuitry of a dual push-pull electromagnetic induction heating device of the present invention.
Figure 2:
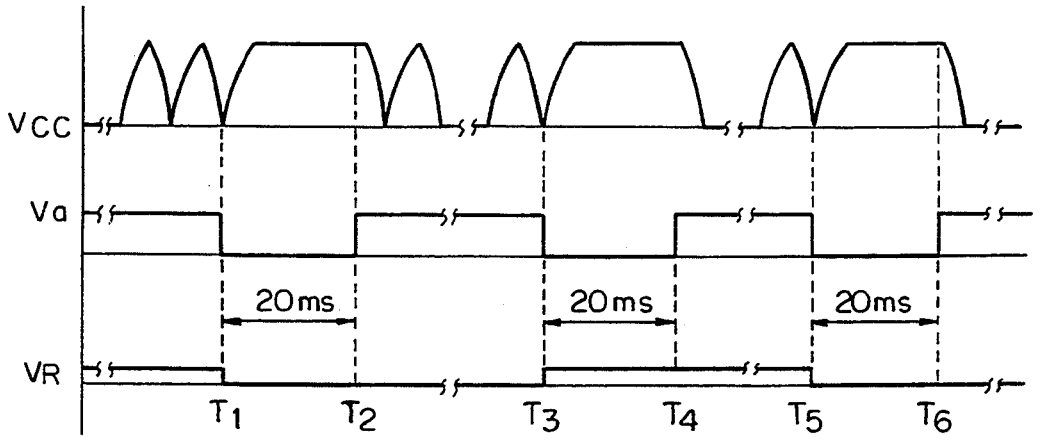
FIG. 2 shows a wave form diagram of circuit switching action of an induction cooker having multiple burners according to the present invention.

Referring to FIGS. 1 and 2, a dual push-pull heating device of an induction cooker having multiple burners of the present invention is shown to comprise a microprocessor 10 programmed to regulate output lines 11 sending out an output control signal Va and to regulate the two output lines to send out two high-frequency pulse signals V1 and V2 via a logic oscillation circuit 20 and two amplifying drive circuits 21 and 22. These two pulse signals V1 and V2 drive the two power elements Q1 and Q2 to communicate alternately with ON/OFF. In other words, the two power elements Q1 and Q2 take turns to communicate with ON/OFF so as to prevent both power elements Q1 and Q2 from communicating with ON at the same time. These two power elements Q1 and Q2 are respectively parallel with two diodes D1 and D2, capacitors C1, C2, C3, and both ends of rectifying power source BR. Two electromagnetic induction coils LA and LB are interconnected between a common point P2 of capacitors C1 and C2 and a common point P1 of power elements Q1 and Q2. The common point P3 of induction coils LA and LB is in communication with a common point P4 of a relay Ry whose normal close point P5 is connected with another end of the induction coil LB, or the common point P2 of capacitors C1 and C2, and whose normal open point P6 is in communication with another end of the induction coil LA, or the common point P1 of power elements Q1 and Q2. The relay Ry is under the control of a signal VR of the microprocessor 10, with an option of selecting P5 or P6 as a connection point.

In operation, the power elements Q1 and Q2 are controlled by logic oscillation circuit 20 and amplifying drive circuits 21 and 22 for carrying out a high-frequency alternating communication. According to the present invention, the induction coil LA and the induction coil LB can be selectively activated by the relay Ry. The four possible current situations of the present invention are described as follows:

1. When VR has a low potential, the relay remains inactivated, with common point P4 communicating with normal close point PS:

(a) When Q1 is activated with 02 remaining OFF, the electric current I1 flows from Vcc through Q1, induction coil LA, connection points P4, PS, P2 and capacitor C2, with energy being stored by induction coil IA; subsequently the power element Q1 stops its action, the induction coil LA charges the capacitor C1 via the diode D2 and Vcc.

(b) Q2 is activated with Q1 remaining OFF, the capacitor C1 discharges the current I2 which flows via connection points P5 and P4 to the induction coil LA and the power element Q2, thereby resulting in the induction coil LA to store the energy in a reverse direction; with Q2 deactivated, the induction coil LA releases the energy via capacitor C2 and diode D1.

The currents I1 and I2 flow through the induction coil LA in opposite directions, thereby causing the induction coil LA to bring about an alternating magnetic field.

2. If the relay is in action, the common point P4 is in communication with the normal open point P6:

(a) With Q1 activated and Q2 remaining OFF, the current I1 flows from Vcc through Q1, common points P6, P4, induction coil LB, connection point P2, capacitor C2 so that the energy is stored in induction coil LB; with Q1 deactivated, the induction coil LB charges the capacitor C1 via the connection points P4 and P6, the diode D2.

(b) With Q2 activated and Q1 remaining OFF, the current I2 is discharged by capacitor C1 to flow to the power element Q2 via connection point P2, induction coil LB, connection points P4, P6, P1, thereby resulting in storing the energy in the induction coil LB in another direction; with Q2 deactivated, the induction coil LB releases the energy via capacitor C2 and diode D1.

The currents I1 and I2 flow through the induction coil LB in opposite directions so as to cause the induction coil LB to bring about an alternating magnetic field.

As shown in FIG. 2, the relay Ry is activated when VR is of low potential Lo (beginning at T1). As a result, P4 and P5 are connected so as to activate the induction coil LA. In order to prevent the connection point from sparking at the time when the switching action of Va takes place, Va is made to have a low potential so as to cause Vcc to stop oscillating. In the meantime, the microprocessor 10 is delayed for about 20 ms before making the control signal Va to have a high potential (T2). That is to say that the logic oscillation circuit 20 begins oscillating to make VR to have a high potential (T3), thereby resulting in activation of the relay Ry and in the connection of P4 and P6. As a result, the induction coil LB is activated, while the control signal Va becomes a low potential for 20 ms until the control signal Va becomes a high potential at T4. This is to ensure that the relay Ry and connection point are in a state of stability. Accordingly, the actions of T5 and T6 are similar. The interval between T2 and T3 represents the action time of the induction coil LA while the interval between T4 and T5 represents the action time of the induction coil LB. An appropriate allocation of action time can be achieved by means of a microcomputer so as to set up the power of each of the two burners.

On the basis of what has been described above, it is apparent that the two power transistors Q1 and Q2 are driven alternately so as to alter the direction in which the current flows through the induction coil LA or LB, thereby bringing about a dual push-pull alternating magnetic field. Due to the fact that the terminal voltage of the two power transistors is lower, the voltage-resisting demand of the dual push-pull power transistors is lower than that of the single push-pull power transistor. In addition, one of the two induction coils can be selected for action by means of a relay Ry or a microcomputer. The two induction coils LA and LB can be alternately activated by a periodic switching of the action of the relay Ry. Therefore, both induction coils LA and LB can simultaneously bring about heat for both burners of the induction cooker. Furthermore, the magnitude of the power output of each of the induction coils can be regulated by adjusting the diameter of the induction coil or the number of the turns of coil as shown with dissimular coil turns and coil diameters on induction coils LA and LB.

According to the preferred embodiment of the present invention described above, the control of heat generation by the two induction coils can be achieved by means of a microprocessor, a logic amplifying drive circuit, at least a power transistor, and a relay. Accordingly, if two relays are employed, a total of four induction coils may be used for heating so as to reduce the cost of making an induction cooker having multiple burners.

The embodiment of the present invention described above is to be regarded in all respects as merely illustrative and not restrictive. Therefore, the present invention is to be limited only by the scope of the hereinafter appended claims.

What is claimed is:

1. A dual push-pull heating device of an induction cooker having multiple burners comprising logic amplifying drive circuitry;

a power element connected to receive high frequency signals from said logic amplifying drive circuitry;

at least two induction coils connected in parallel;

a relay connected to said induction coils, and having a common connection point connected to commonly connected ends of said induction coils, and a normally closed position of said relay with said common connection point connected to a non-common end of one of said induction coils, and a normally open position of said relay with said common connection point connected to a non-common end of another of said induction coils.

2. The dual push-pull heating device of an induction cooker having multiple burners of claim 1 wherein said power element includes two interconnected power transistors having a common connecting point between hem and connected to said induction coils at said common connecting point of said transistors, said two power transistors being driven alternately by said logic amplifying drive circuitry for alternating driving power through a said induction coil.

3. The dual push-pull heating device of an induction cooker having multiple burners of claim 1 wherein said induction coils have dissimilar coil turns and coil diameters.

4. The dual push-pull heating device of an induction cooker having multiple burners of claim 1 further comprising a microcomputer connected to send a control signal to regulate said logic amplifying drive circuitry.

5. The dual push-pull heating device of an induction cooker having multiple burners of claim 4 wherein said control signal of said microcomputer is delayed for a predetermined period of time in relation to a switching action of said relay.

* * * * *